United States Patent [19]

Higuchi et al.

[11] 3,965,408

[45] June 22, 1976

[54] CONTROLLED FERRORESONANT TRANSFORMER REGULATED POWER SUPPLY

[75] Inventors: Hobart Atsushi Higuchi; Lawrence Paul Trubell, both of San Jose, Calif.

[73] Assignee: International Business Machines Corporation, Armonk, N.Y.

[22] Filed: Dec. 16, 1974

[21] Appl. No.: 533,428

[52] U.S. Cl. ..... 321/25; 323/48; 323/56; 323/60; 336/184; 336/212; 336/215

[51] Int. Cl.[2] ..... H01F 27/38; G05F 1/48; G05F 1/64

[58] Field of Search ..... 321/25; 323/6, 48, 56, 323/60, 61, 62, 89 C; 336/178, 184, 212, 215

[56] References Cited

UNITED STATES PATENTS

| | | | |
|---|---|---|---|
| 1,588,571 | 6/1926 | Busse | 323/89 C |
| 2,136,895 | 11/1938 | Sola | 336/212 X |
| 2,289,175 | 7/1942 | Boucher | 336/212 X |
| 2,466,028 | 4/1949 | Klemperer | 323/56 X |
| 2,469,960 | 5/1949 | Gilson et al. | 323/60 X |
| 3,148,326 | 9/1964 | Baycura et al. | 323/56 |
| 3,374,398 | 3/1968 | Horn et al. | 323/56 X |
| 3,636,433 | 1/1972 | Hyatt | 323/48 UX |

*Primary Examiner*—A. D. Pellinen
*Attorney, Agent, or Firm*—George E. Roush

[57] ABSTRACT

Standard configuration a.c. power transformer core sections are combined with standard configuration solenoid winding sections to provide a saturable core transformer which is arranged to be driven into saturation by applied alternating and direct current energy with the control of variations in flux changes up to saturation exercised by the direct current flow. A center tapped primary winding is arranged on an I-shaped stack of transformer iron laminations for full-wave excitation. A C-shaped stack of laminations is arranged adjacent to the I-shaped stack and separated by an air gap whereby the primary winding also serves as an input filter choke. The core structure is completed by an E-shaped stack of laminations arranged adjacent to the I-shaped stack and separated by another air gap. Two solenoid windings are arranged on the outer legs of the E-shaped stack and connected to a capacitor for resonating the overall ferroresonant transformer circuit arrangement. Secondary windings are also arranged on the outer legs and connected to a rectifying circuit for supplying direct potential to a load. A control winding is arranged on the central leg of the E-shaped stack of laminations. With this arrangement, the control winding is unaffected by variations in the a.c. voltage as they affect the flux changes in the transformer or in the frequency of the a.c. Regulation of the power supply is executed by direct current flow in the control winding. An adjustable resistor connecting the control winding across the output of the rectifier circuit is often all that is required to complete the circuit. In some applications, an amplifying circuit is used to provide a desired gain in the control winding circuitry.

11 Claims, 4 Drawing Figures

CONTROLLED FERRORESONANT TRANSFORMER REGULATED POWER SUPPLY

The invention relates to electric power supply arrangements and it particularly pertains to such arrangements having the output regulated by driving an a.c. power supply transformer toward saturation under controlled conditions.

Controlled ferroresonant transformer regulated power supplies have been known for about four decades. Much promise has been shown but heretofor the control has been lacking even with the more complex control arrangements devised. Examples of such power supplies are described in the following U.S. patents:

| | | | |
|---|---|---|---|
| 1,953,773 | 4/1934 | Richhart | 323/44R |
| 1,967,108 | 7/1934 | Werner | 307/7 |
| 2,143,745 | 1/1939 | Sola | 323/60 |
| 2,706,271 | 4/1955 | Fletcher | 323/48 |
| 2,777,987 | 1/1957 | Deal | 323/56 |
| 3,148,326 | 9/1964 | Baycura et al | 323/56 |
| 3,253,212 | 5/1966 | Wentworth | 323/56 |
| 3,316,481 | 4/1967 | Owen | 323/6 |
| 3,341,766 | 9/1967 | Rhyne, Jr. | 321/9 |

And in the technical literature:

E. W. Manteuffel and R. O. McCary; "The D-C Controlled A-C Voltage Source, A New Magnetic Amplifier;" Preceedings of the AIEE; Nov. 1957, pp. 562–6.

R. N. Basu; "A New Approach in the Analysis and Design of a Ferroresonant Transformer;" IEEE Transactions on Magnetics; Mar. 1967, pp 43–9.

R. J. Kakalec; "A Feedback-Controlled Ferroresonant Voltage Regulator"; IEEE Transactions on Magnetics; Mar. 1970, pp 4–8.

P. L. Hunter; "Variable Flux-Reset Ferroresonant Voltage Regulator"; IEEE Transactions on Magnetics; Sept. 1971, pp 564–7.

R. H. Randall, W. R. Archer, and R. M. Lewis; "A New Controlled Constant-Voltage Transformer;" IEEE Transactions on Magnetics; Sept. 1971, pp 567–71.

H. P. Hart and R. J. Kakalec; "A New Feedback-Controlled Ferroresonant Regulator Employing a Unique Magnetic Component;" IEEE Transactions on Magnetics; Sept. 1971, pp 571–4.

R. Walk, R. J. Kakalec and J. Rootenberg; "An Analytical and Computer Study of the Jump Phenomenon in Ferroresonant Regulators;" IEEE Transactions on Magnetics; Sept. 1971, pp 574–7.

The patents to Richart, Werner and Sola and the articles of Manteuffel et al, Basu and Kakalec are directed to basic ferroresonant transformer power supply regulating circuit arrangements. These teachings apply in general to the embodiment of the invention and the patents are considered to be closer prior art in this respect than the others listed. However, these reference patent arrangements require critically tapped windings, additional core structure or specially cut core laminations although not critical in stamping and the regulation in each core is sensitive to variations in the frequency of the line voltage.

The patents to Fletcher, to Baycura et al, and to Rhyne and the articles to Basu, to Hunter, and to Hart are directed to ferroresonant transformers having nonstandard core laminations and tapped winding sections among other features obviated by the arrangement according to the invention. The patents to Deal and to Owen show core laminations of some complexity in punching and in assembly with the winding sections. Also, the patent to Owen shows a moveable transformer core section that is obviated by the arrangement according to the invention.

The patent to Wentworth and the article to Hunter are directed to ferroresonant transformer a.c. voltage regulating arrangements having a control winding divided into two sections and arranged on separate outer legs of the transformer in compensating for the effect of a.c. voltage from the primary windings on the control winding.

The arrangements of Hunter and Kakalec simulate saturation by firing a thyristor (or a triac or an SCR) across a winding. This arrangement requires complex synchronizing circuitry for maintaining synchronism with the a.c. input voltage.

Control windings as such are absent from the arrangements of Richhart, Werner, Sola, Fletcher, Rhyne, Jr., Basu, and of Walk et al. The arrangements of Baycura et al have a single or double section control winding which is wound through an aperture in the core lamination stack. Two section windings are used by Wentworth as described hereinbefore, while Deal uses one control winding section and one "bias" winding section with separate control current supplies of two different current characteristics. The article of Walk et al discusses a complex feedback arrangement as does the article to Randall et al which also includes a tapped control winding.

The objects of the invention indirectly referred to hereinbefore and those that will appear as this specification progresses are attained in a controlled ferroresonant transformer regulated power supply of simple form and improved performance.

The electric energy transformer according to the invention comprises stacks of electric transformer iron core laminations in I, C, and E configurations and a number of solenoid winding sections arranged on legs of the core lamination stacks. In one exemplary embodiment of the invention, two solenoid winding sections are arranged on the I-shaped stack of laminations as a full wave primary winding whereby the direction of magnetic flux lines alternates each half cycle. The C-shaped stack of laminations is arranged adjacent the I-shaped stack of laminations and separated by an air gap to realize a filter choke for providing the effect of a smoothing choke in the primary winding circuit of the power supply. The remaining E-shaped stack of laminations is arranged adjacent to the I-shaped stack with an air gap separating the two. This air gap stabilizes the gain of the regulating circuit. Two secondary winding sections are individually arranged on the two outer legs of the E-shaped laminations and connected to a full-wave rectifier circuit for supplying direct current to a load. Somewhat similarly, another pair of windings are arranged on the legs of the E-shaped laminations and connected to a capacitor for providing a circuit resonant to a predetermined frequency related to the frequency of the input a.c. energy much as in the conventional ferroresonant power supply. Further according to the invention, a control winding section is arranged on the central let of the E-shaped laminations, in predetermined flux pattern relationship whereby the current in the control winding at any time is independent of the a.c. input and the induced a.c. voltages. Direct current for the control winding is obtained from the output of the rectifier circuit by a simple series resistor of adjusted value or a simple potentiometer whereby the current varies directly proportionally to the direct potential at the output of the rectifier circuit and across the load circuit. The transformer core is driven toward saturation by the a.c. input energy and the d.c. through the control winding. The latter current varies directly as the output voltage to maintain it substantially constant. This arrangement is insensitive to variations in output voltage that otherwise would be present due to changes in the frequency of the a.c. supply.

In order that the practical advantages obtain in the practice of the invention, a preferred embodiment thereof will be described in greater detail with reference to the accompanying drawing forming part of the specification and in which.

Figure 1:
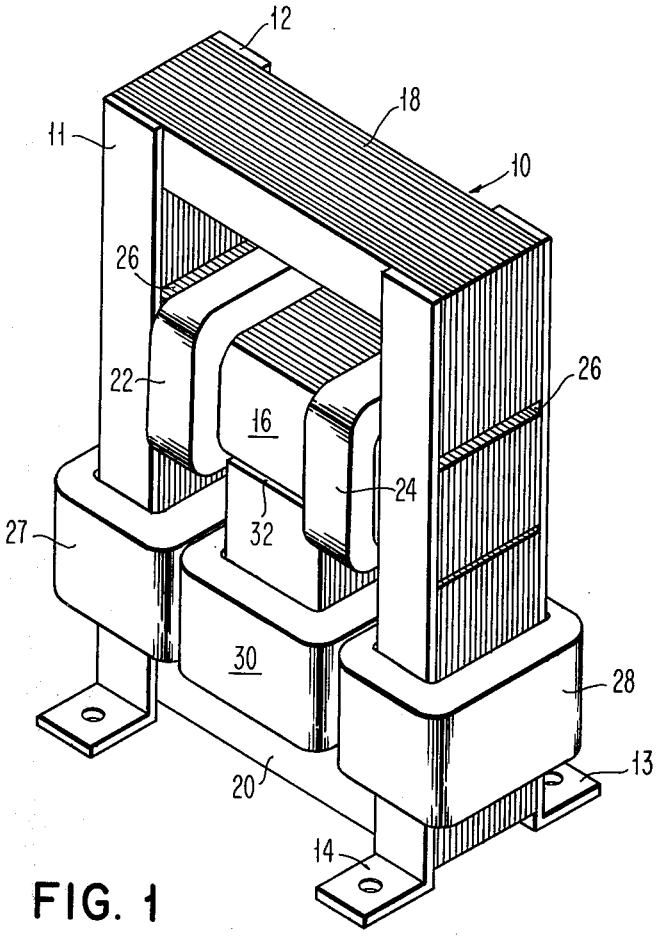
FIG. 1 is a perspective view of a transformer for a power supply according to the invention.

A perspective view of an a.c. transformer 10 as arranged according to the invention is given in FIG. 1. The core of the transformer comprises a multiple of transformer iron laminations clamped tightly in four L-shaped and/or mounting members 11–14. A case (not shown) is shaped to slip over the transformer and firmly clamp the mounting members. The core laminations are further divided into three discrete I-, C-, and E-shaped stacks 16,18,20. The central stack 16 is of I-shaped configuration and two solenoid winding sections 22,24 are arranged thereon. The C-shaped stack 18 carries no winding. It is arranged adjacent the stack 16 with air gaps 26,26 in the magnetic circuit. In this manner a filter choke structure is effected for a purpose more completely described hereinafter. The remaining E-shaped stack 20 of laminations is arranged adjacent to the central stack 16 with an air gap 32 in the magnetic circuit of the transformer. Secondary winding sections 27,28 are arranged on the outer legs of the transformer structure. A control winding 30 is arranged on the central leg of the E-shaped stack 20. The air gap 32 arranged between the stack 30 and the stack 16 is smaller than the air gap 26. From this view it is readily seen that relatively standard configurations of laminations are used. No apertures of any kind are necessary in any of the laminations, and no special shaping is necessary. Of course, L-shaped, I-shaped and T-shaped laminations can be used to make up stacks of E-shaped laminations and so on. Likewise, the winding sections are relatively standard solenoids and are readily slipped into the laminations without any necessity for winding in place or for torroidal and like winding machinery.

Figure 2:
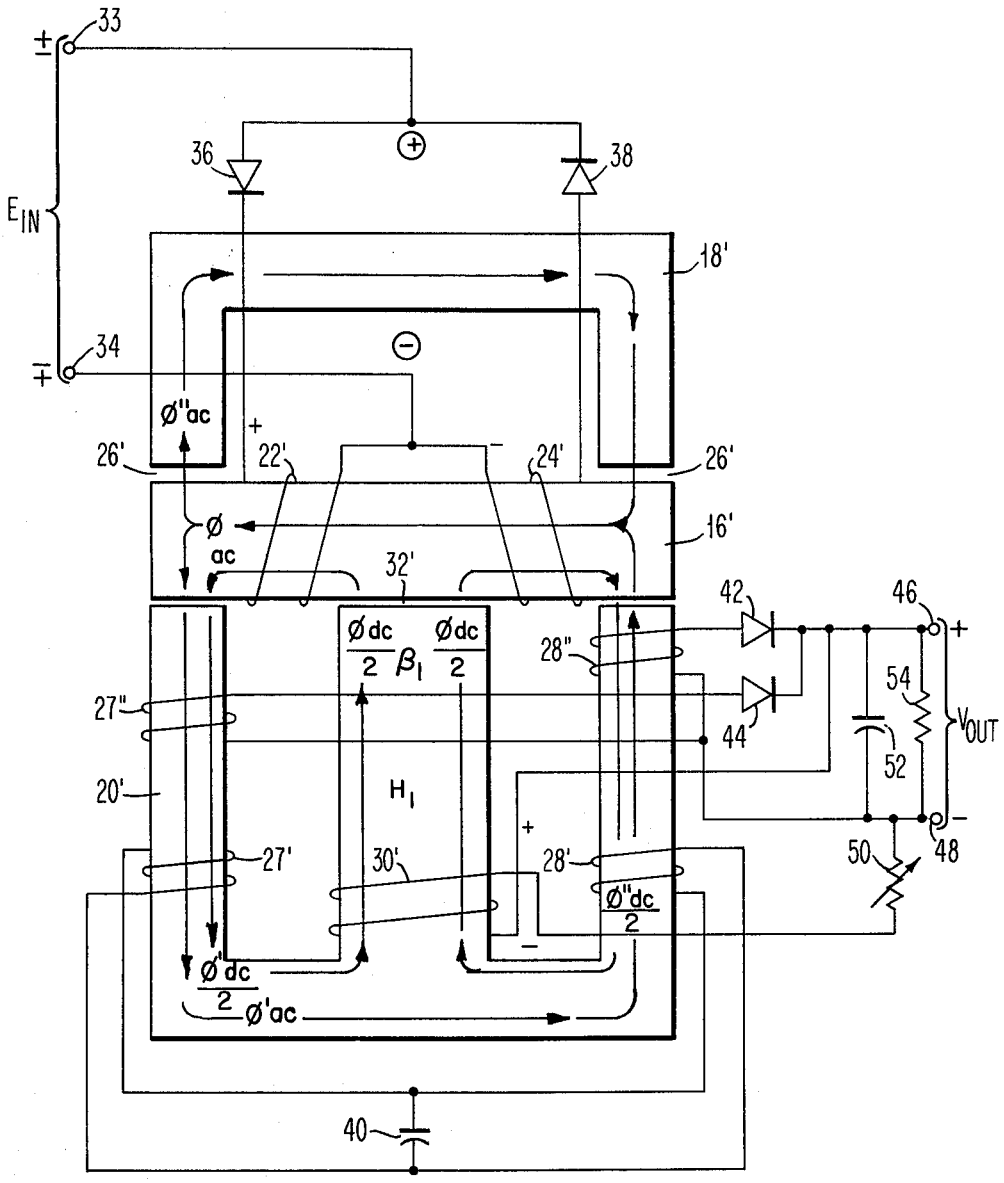
FIG. 2 is a schematic diagram of a power supply according to the invention using that transformer.

The transformer is shown schematically in FIG. 2. Primed reference numerals correspond to the reference numerals in the previously described view. Alternating potential is applied at input terminals 33,34. One terminal 33 is connected to the primary winding sectons 22',24' by isolating diodes 36,38 respectively. The other terminal 34 is connected to the common central terminal of the windings 22',24'. The resonating windings 27',28' are connected to a capacitor 40 as shown. Secondary windings 27'',28'' are connected to a full wave rectifier circuit having rectifying diodes 42,44 for delivering direct potential to a pair of output terminals 46,48. The control winding 30' is connected between the cathode electrodes of the rectifying diodes 42,44 and the terminal 48 by an adjustable resistor 50. Alternatively, a potentiometer (not shown) is connected as shown in FIG. 8 of the above-listed U.S. Pat. No. 3,148,326. Preferably, a smoothing capacitor 52 is connected across the terminals 46, 68. A bleeder resistor 54 is optional. Alternatively, in some applications, the resonating winding sections 27',28' are combined in effect with the secondary winding sections 27'',28'' and a resonating capacitor is connected across the secondary winding or a portion thereof. Such an arrangement is shown in the above-mentioned U.S. Pat. No. 3,148,326.

The basic theory of operation of ferroresonant transformers (constant voltage stabilizers) is well established. The invention utilizes the same principles except that the net change in magnetic flux density per half cycle of the saturating transformer core is controlled with a control winding.

The output voltage across the secondary windings of a ferroresonant transformer is:

$$E_o = 2\Delta\beta AcfNs\times10^{-8} \text{ volts} \quad (1)$$

where $\Delta\beta$ is the change in flux density per half cycle $Ac$ is the cross-sectional area of the outer legs of the core;

$f$ is the operating frequency; and $N_s$ is the number of turns of the secondary winding.

With the operating frequency substantially constant, the output voltage is maintained substantially inversely proportional to current flow in the control winding 30' according to the invention by the simple feedback arrangement shown.

Figure 3:
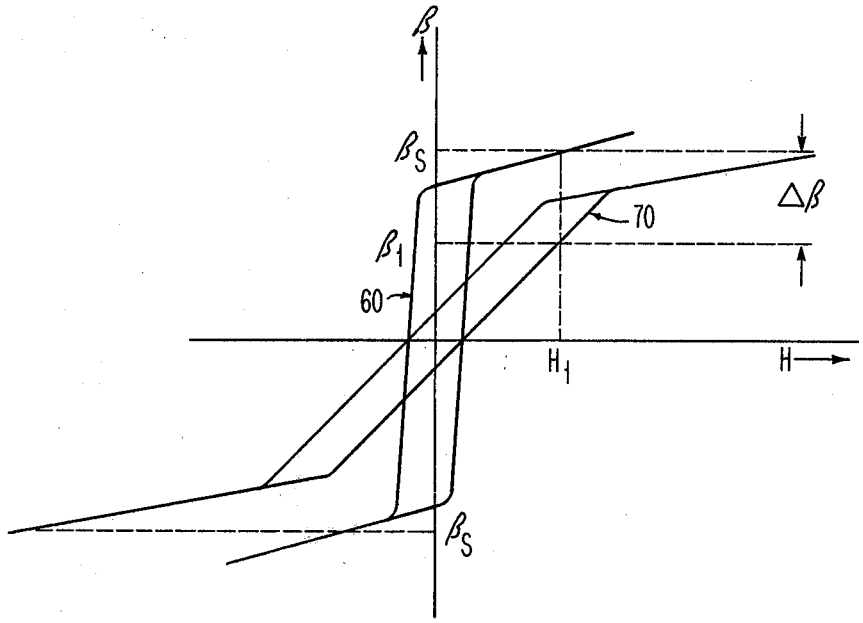
FIG. 3 is a diagram illustrating the $\beta$-H characteristics of the transformer according to the invention.

The $\beta$-H characteristics of the outer legs of the core stack 20 is shown by a curve 60 in FIG. 3 while the $\beta$–$H$ characteristic for the central leg is depicted by another curve 70. The latter differs from the former because of the effect of the air gap 32. With direct current applied to the control winding 30 a magnetomotive force $H_1$ as shown will be imposed on the center leg of the core. A flux density equal to $\beta_1$ will then be established in the center leg. Assuming that the reluctance of both outer legs are equal, a flux density of $\beta_1$ will be established in each outer leg. By connecting the respectively primary windings in the proper phase relationship as shown in FIG. 2, the net $\Delta\beta$ that will occur during each half cycle for each outer leg will be $\beta_s-\beta_1$. Hence, by increasing the control current, $I_c$, $\Delta\beta$ is reduced and the output voltage $E_o$ will decrease.

The gain equation is derived as follows:

$$\Delta\beta = \beta_s - \beta_1 \quad (2)$$

$$\beta_1 = \mu_d H_1 \quad (3)$$

where $\mu_d$ is the effective core permeability with an air gap $l_g$ $$\mu_d = \frac{\mu_m l_m}{l_m + \mu_m l_g} \quad (4)$$

where $l_m$ is mean flux path of the center leg, and $\mu_m$ is the core material permeability and $$\text{and } H_1 = \frac{0.4\pi N_c I_c}{l_m} \quad (5)$$

where $N_c$ is the number of turns in the control winding $I_c$ is the control current Substitution of (3), (4) and (5) into (2) yields:

$$\Delta\beta = \beta_s - \frac{0.4\pi\mu_m N_c I_c}{l_m + \mu_m l_g} \quad (6)$$

Substituting equation (6) into equation (1):

$$E_o = 2AcfNs \frac{[\beta s - 0.4\pi\mu_m N_c I_c]}{l_m + \mu_m l_g} \times 10^{-8} \quad (7)$$

Differentiating (7) with respect to control current $I_c$, the desired gain equation is:

$$G = \frac{dE_o}{dI_c} = \frac{-0.8\pi\mu_m N_c N_s f A_c X 10^{-8}}{l_m + \mu_m l_g} \quad (8)$$

if $\mu_m l_g << l_m$, then:

$$G = \frac{-0.8\pi N_c N_s f A_c X 10^{-8}}{l_g} \quad (9)$$

Equation (9) shows that the gain is controlled by defining the frequency of operation, judicious choice of control and secondary windings, and specifying appropriate core dimensions and gap length according to the invention.

The power supply functions in direct manner. The a.c. input power source is applied to terminals 33 and 34. Assuming, as shown by the + and − signs in the circles, that terminal 33 is positive and terminal 34 negative, the a.c. flux $\phi$ac, set up by the winding 22' is in the clockwise direction. Control current, $I_c$ flowing in winding 30' as shown sets up flux $\phi dc/2$ in each of the outer legs of the lower half of the core 20'. The flux shown veering to the left aids $\phi$ac, and the flux veering to the right opposes $\phi$ac.

Because of the air gap 26 separating the C-shaped stack 18 from the I-shaped stack 16 of the core, the magnetic reluctance path around the outer right leg of the E-shaped stack 20 will present a lower reluctance to the flux $\phi$ac + $\phi$dc until the core leg saturates. Hence, as this flux flows, power will be applied to the load, across terminals 46 and 48, winding 28'' and diode 42. At the same time, since the resonating winding sections are in parallel, both the outer legs will experience the same flux change. As the right outer leg saturates and the refluctance increases, the ac flux will be forced to flow upwards through the air gap 26 and the upper lamination stack 18. The flux change through outer legs of the E-shaped core goes to zero and no more energy is transferred to the load for the remainder of that half cycle. The voltage across the resonating winding section collapses and the voltage across the resonating capacitor 40 is discharged.

As the polarity across terminals 33 and 34 reverses on the next half cycle, the same explanation is valid for the left side of the magnetic circuit.

With the proper choice of values for the resonating capacitor 40, the resonating winding sections 27,28 for resonance at the a.c. line frequency and the air gap 32 for a given core geometry, the ferroresonant phenomenon obtains and the output waveform will be trapezoidal with the net rectified dc voltage across the terminal 46 and 48.

Because the saturation flux level of the outer legs can be varied as a function of current in the winding 30, the net result is a ferroresonant regulator with closed loop control in a single unique magnetic structure.

Figure 4:
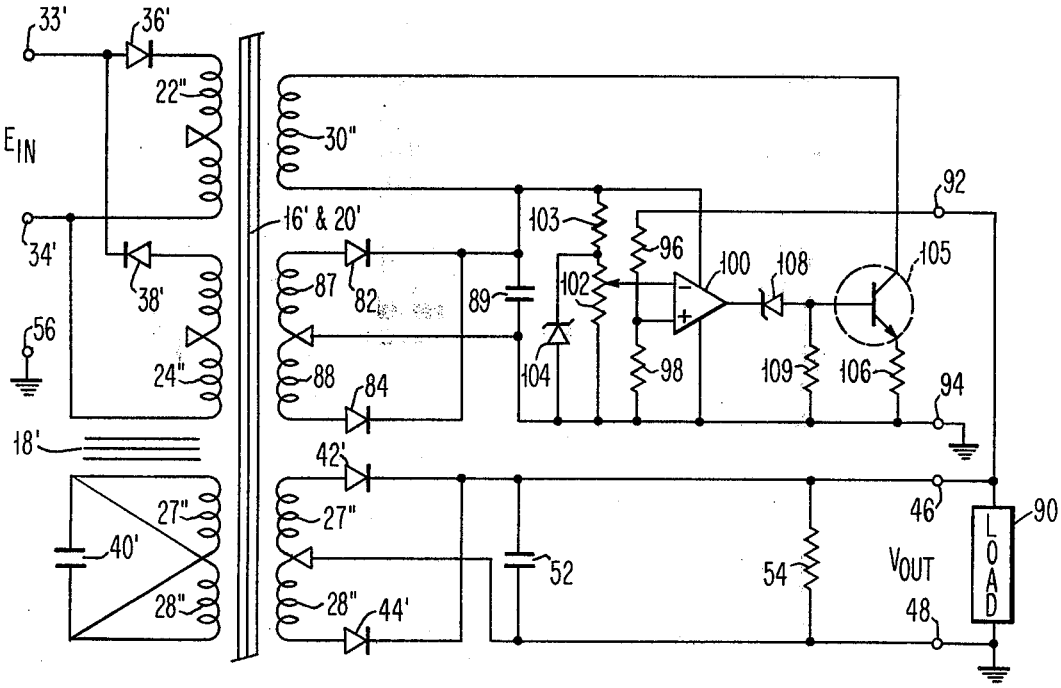
FIG. 4 is a schematic diagram of an alternate circuit according to the invention.

An alternate embodiment of the invention is shown schematically in FIG. 4. The arrangement is similar in many respects to that previously described. The core of the transformer is denoted by the reference numbers 16' and 20', while the magnetic shunt 18' is depicted in conventional form for that structure in ferroresonant transformer diagrams. The power available across the d.c. output terminals 46,48 is frequently used for maintaining the control current but a separate supply is preferably used as is shown here. This auxiliary supply comprises rectifying diodes 82,84, secondary winding sections 87,88, and a smoothing capacitor 89. A bleeder resistor is optional.

The voltage across the remotely located load 90 is applied to input terminals 92,94 of a control current translating circuit arrangement. This voltage is divided by resistors 96,98 and the resultant "error signal" applied to one input terminal of a differential amplifying circuit 100 at the output of which an "actuating signal" is generated. The other input terminal is connected to the arm of a command potentiometer 102 connected in a stable "reference input" d.c. level potential network. This network is a part of the amplifier circuit 100 as readily available commercially. Alternately, this network circuit is external to the amplifier circuit 100 as shown. A dropping resistor 103 and a Zener diode 104 are optional. The control current flowing through the control winding 30'' is obtained from the collector-emitter electrode circuit of a final current controlling transistor 105 having a resistor 106. Another Zener diode 108 is connected between the base electrode of the transistor 104 and the amplifying circuit 100 for level shifting purposes. Leakage current flows through a resistor 109. The control current through the winding 30'' is varied by adjustment of the potentiometer 102 in the reference potential and actuating signal generating circuitry.

The regulation of the supply output voltge is obtained by a d.c. control current obtained from a d.c. monitoring point, whereby the circuit is not sensitive to changes in the frequency of the a.c. input source in any way.

While the invention has been described and illustrated in terms of a preferred embodiment, and alternate structure has been suggested, it is to be clearly understood that those skilled in the art will make additional changes without departing from the spirit and scope of the invention as defined in the appended claims.

The invention claimed is:

1. A controlled ferroresonant transformer for a regulated power supply circuit arrangement comprising a ferromagnetic electric transformer core comprising an E-shaped stack of laminations, and I-shaped stack of laminations and a C-shaped stack of laminations, a primary winding arranged on said I-shaped stack with said C-shaped stack adjacent and spaced by an air gap for imparting the effect of a filter choke, a secondary winding comprising two coils arranged on the outer legs of said E-shaped stack with the E-shaped stack adjacent said I-shaped stack and spaced by an air gap, a resonating winding comprising two coils arranged on the outer legs of said E-shaped stack, and a control winding arranged on the central leg of said E-shaped stack.

2. A controlled ferroresonant transformer assembly for a regulated power supply circuit arrangement comprising a ferromagnetic electric transformer core comprising an E-shaped stack of laminations, an I-shaped stack of laminations and a C-shaped stack of laminations, a primary winding arranged on said I-shaped stack with said C-shaped stack adjacent and spaced by an air gap for imparting the effect of a filter choke, a secondary winding comprising two coils arranged on the outer legs of said E-shaped stack with the E-shaped stack adjacent said I-shaped stack with an air gap, a resonating winding comprising two coils arranged on the outer legs of said E-shaped stack, a capacitor connected across said resonating winding, and a control winding arranged on the central lag of said E-shaped stack.

3. A controlled ferroresonant transformer as defined in claim 2 and wherein said capacitor and said resonating winding have values of capacity and inductance at which the subcircuit thereby comprised is substantially resonant at the frequency of the alternating current for which the transformer is designed.

4. A controlled ferroresonant transformer regulated power supply circuit arrangement comprising a ferromagnetic electric transformer core comprising an E-shaped stack of laminations, an I-shaped stack of laminations and a C-shaped stack of laminations, a primary winding arranged on said I-shaped stack with said C-shaped stack adjacent and spaced by an air gap for imparting the effect of a filter choke, a secondary winding comprising two coils arranged on the outer legs of said E-shaped stack with the E-shaped stack adjacent said I-shaped stack with air gap for stabilizing device gain, a resonating winding comprising two coils arranged on the outer legs of said E-shaped stack, a capacitor connected across said resonating winding, a rectifier connected to said secondary winding, a resistor connected to the output of said rectifier, and a control winding arranged on the central leg of said E-shaped stack and connected in series with said resistor and said rectifier.

5. A controlled ferroresonant transformer regulated power supply circuit arrangement as defined in claim 4 and incorporating isolating diodes interposed at the terminals of said primary winding.

6. A controlled ferroresonant transformer regulated power supply circuit arrangement as defined in claim 4 and wherein a reference potential and actuating signal generating circuit is connected between said control winding and said resistor and arranged for adjusting current flow in said control winding.

7. A controlled ferroresonant transformer regulated power supply circuit arrangement as defined in claim 6 and wherein said reference potential and actuating signal generating circuit is adjustable.

8. A controlled ferroresonant transformer regulated power supply circuit arrangement as defined in claim 4 and incorporating a variable resistance device having a control terminal and having a resistance element interposed in series with said resistor, said control winding and said rectifier, a differential amplifying circuit having an output terminal coupled to said control terminal and two input terminals, electric circuitry connected across said rectifier for deriving an input signal reflecting any variation in potential and connected to one of said input terminals of said amplifying circuit, an electric circuit arranged for generating a reference input level substantially free from said variation and connected to the other input terminal of said amplifying circuit, other secondary winding sections arranged on the outer legs of said E-shaped core stack, and another rectifier circuit connected between said other secondary winding sections and said amplifying circuit for energizing the latter circuit.

9. A controlled ferroresonant transformer regulated power supply circuit arrangement as defined in claim 8 and incorporating a potentiometer connected in the reference input level generating circuit of said interconnected amplifying circuit and said rectifying circuit and having a tapping connected to the other input terminal of said amplifying circuit.

10. A controlled ferroresonant transformer regulated power supply circuit arrangement as defined in claim 8 and wherein said variable resistance device comprises a current controlling transistor connected to said amplifying circuit and having the collector-emitter electrode circuit connected in series with said control winding and said rectifier circuit independently of said connections for energizing said amplifying circuit.

11. A controlled ferroresonant transformer regulated power supply circuit arrangement comprising a ferromagnetic electric transformer core comprising an E-shaped stack of laminations, an I-shaped stack of laminations and a C-shaped stack of laminations, a primary winding arranged on said I-shaped stack with said C-shaped stack adjacent and spaced by an air gap for imparting the effect of a filter choke, a secondary winding comprising two coils arranged on the outer legs of said E-shaped stack with the E-shaped stack adjacent said I-shaped stack with air gap for stabilizing device gain, a resonating winding comprising two coils arranged on the outer legs of said E-shaped stack, a capacitor connected across said resonating winding, said capacitor and said resonating winding have values of capacity and inductance at which the subcircuit thereby comprised is substantially resonant at the frequency of the alternating current for which the transformer is designed, a control winding arranged on the central leg of said E-shaped stack, a rectifier connected to said secondary winding, electric leads for connecting an electric load device to said rectifier, a differential amplifying circuit having two input terminals and an output terminal, other secondary winding sections arranged on the outer legs of said E-shaped core stack, and another rectifier circuit connected between said other secondary winding sections and said amplifying circuit for energizing the latter circuit, a current controlling transistor having a base electrode connected to said output terminal of said amplifying circuit and having the collector-emitter electrode circuit connected in series with said control winding and said other rectifier circuit, a potentiometer connected in the direct current energizing circuit of said interconnected amplifying circuit and said other rectifying circuit and having a tapping connected to one of the input terminals of said amplifying circuit, and a voltage divider connected between said electric leads for detecting any variation in potential at said electric leads and having a tapping connected to the other input terminal of said amplifying circuit.

* * * * *